US006401696B1

(12) United States Patent
Heimberg

(10) Patent No.: US 6,401,696 B1
(45) Date of Patent: Jun. 11, 2002

(54) FUEL INJECTION DEVICE FOR INTERNAL COMBUSTION ENGINES

(75) Inventor: Wolfgang Heimberg, Ebersberg (DE)

(73) Assignee: Ficht GmbH & Co., KG (DE)

( * ) Notice: Subject to any disclaimer, the term of this patent is extended or adjusted under 35 U.S.C. 154(b) by 0 days.

(21) Appl. No.: 08/945,976

(22) PCT Filed: Apr. 24, 1996

(86) PCT No.: PCT/EP96/01715

§ 371 (c)(1),
(2), (4) Date: Jun. 5, 1998

(87) PCT Pub. No.: WO96/34196

PCT Pub. Date: Oct. 31, 1996

(30) Foreign Application Priority Data

Apr. 28, 1995 (DE) ..... 195 15 782

(51) Int. Cl.[7] ..... F02M 37/04
(52) U.S. Cl. ..... 123/499; 417/417
(58) Field of Search ..... 123/498, 499, 123/497; 417/417, 490, 499, 415, 416

(56) References Cited

U.S. PATENT DOCUMENTS 4,743,179 A * 5/1988 Waas et al. ..... 417/417
4,895,495 A * 1/1990 Arai ..... 417/360
5,469,828 A * 11/1995 Heimberg et al. ..... 123/497
5,492,449 A * 2/1996 Hunklinger et al. ..... 417/417
5,520,154 A * 5/1996 Heimberg et al. ..... 123/499
5,630,401 A * 5/1997 Binversie et al. ..... 123/495
5,779,454 A * 7/1998 Binversie et al. ..... 417/417

FOREIGN PATENT DOCUMENTS

| | | |
|---|---|---|
| DE | 20133 | 5/1953 |
| DE | 1917486 | 5/1969 |
| DE | 2809122 | 3/1978 |
| DE | 213472 | 2/1983 |
| DE | 41060156 | 2/1991 |
| DE | 4206817 C2 | 3/1992 |
| DE | PCTEP00495 | 3/1993 |

* cited by examiner

*Primary Examiner*—Carl S. Miller
(74) *Attorney, Agent, or Firm*—Fletcher, Yoder & Van Someren

(57) ABSTRACT

A fuel injection device works based on the principle of storage of energy in a solid body and is designed as a reciprocating piston pump with a feeding piston (35, 24) that stores kinetic energy during an almost resistance-free acceleration phase. The stored kinetic energy is abruptly transmitted to the fuel contained in a compression chamber (66), generating a pressure wave for injecting fuel through an injection nozzle. The means that interrupt the resistance-free acceleration phase are designed as a valve with a valve body **(50*a*) and a valve seat (57) shaped on the feeding piston (35, 24). To generate the pressure wave, the valve closes the compression chamber (66) so that the kinetic energy of the feeding piston (35, 24) is transmitted to the fuel enclosed in the compression chamber (66). The valve seat (57) and the valve body (50*a*) lie at the front end of the feeding piston (35, 24), seen in the direction of injection, and separate the compression chamber (66) from the feeding piston (35, 24)**.

17 Claims, 5 Drawing Sheets

FUEL INJECTION DEVICE FOR INTERNAL COMBUSTION ENGINES

The invention relates to a fuel injection device operating according to the solid-state energy storage principle, in particular for two stroke engines according to the preamble of claim 1.

Fuel injection devices which operate according to the solid-state energy storage principle are described in EP 0 629 265, in particular with reference to FIGS. 13 to 19. They operate according to the so-called pump stroke and nozzle principle with pressure surge injection, an initial accelerated partial stroke of an armature which acts as a delivery plunger, extends axially on one side and has an electromagnetically driven injection pump is provided, in which armature delivered fuel in the pump system is displaced without a buildup of pressure in the fuel fluid. During this initial partial stroke, the delivery plunger and/or the armature absorbs kinetic energy and stores it, the predetermined flow space, which is ensured by a fuel circuit in the pump system, being made available to the fuel which is displaced in the process. As a result of a sudden, predetermined interruption of the fuel circuit during the resistance-free pretravel of the delivery plunger and owing to the subsequent movement of the delivery plunger, said interruption being brought about by means of a valve device which is arranged in the armature and/or the delivery plunger and is activated by the armature movement, the delivery plunger imparts its stored kinetic energy in a sudden, pressure surge-like fashion to the quantity of fuel which is located in a spatial area of the circuit space—the so-called pressure space—between, and/or in, the delivery plunger and an injection nozzle which is closed off, for example in a spring-loaded fashion, said spatial area being formed by the interruption in the circuit and/or being shut off separately. The sudden buildup in pressure in the fuel to, for example, 60 bar causes the injection nozzle to open and fuel to be injected through the injection nozzle into a combustion space of an internal combustion engine during an extremely short time of, for example, one 1000th of a second.

These pump and nozzle systems, known from EP 0 629 265, comprise an electromagnetically driven reciprocating plunger pump 1 and the injection nozzle 2 (FIG. 1). These pump and nozzle systems have proven useful in particular in two stroke engines in which previously large amounts of pollutants were known to be given off as a result of scavenging losses and a high fuel consumption came about in that a high proportion of fuel was able to pass through the outlet conduit 3 in an unconsumed form, because in two stroke engines the overflow conduit and outlet conduit 3 are opened simultaneously. With the pump and nozzle systems described above, it was then possible to reduce the fuel consumption and the expulsion of pollutants drastically. In addition, the unquiet running of the engine, which was previously due to irregular ignition at low speeds, could now be virtually completely prevented. In this context, the fuel is injected directly into the combustion space 4 of a cylinder 5 for an extremely short time and, specifically, only when the outlet conduit 3 is largely closed. The control 6 for optimizing the pump and nozzle system is provided electronically via, for example, a microprocessor which controls the injection time and the quantity of fuel, the injection time for this being determined as a function of load, for example with a temperature sensor 7, a throttle valve potentiometer 8 and a crack angle sensor 9. The microprocessor expediently also controls the ignition system 10 of the plunger cylinder unit of the engine which is provided with fuel by the pump and nozzle system.

By virtue of these pump and nozzle systems, the hydrocarbon emission is drastically reduced in comparison with other two stroke engines, the running feature in particular at low rotational speeds, being at the same time significantly improved. Carbon monoxide and the oil fed for lubrication are also expelled in significantly smaller quantities so that a two stroke engine of this kind can be compared with a four stroke engine in terms of the emission values, but, nevertheless, has the high performance with low weight which is typical of a two stroke engine.

In the pump and nozzle systems described above, the fuel circuit space is formed by a pressure chamber and a delivery plunger or armature space, the pressure chamber being the partial space area separated off from the pressure space by a static pressure valve and in which the kinetic energy of the armature is transmitted to the fuel, the armature space being the partial space area in which the fuel which is displaced without resistance can flow during the accelerated partial stroke.

According to the known pump and nozzle systems, the armature space can be connected via a housing bore to a fuel flooding or scavenging device, so that fuel can be fed through this partial space area during the injection activity of the armature and/or during the starting phase of the pump and/or of the engine. This flooding or scavenging with, for example cool, bubble-free fuel causes fuel containing bubbles in the armature space to be removed, the armature space and its surroundings to be cooled and the formation of bubbles owing to the effect of heat and/or to cavitation to be largely suppressed.

Under particular conditions, in particular when the fuel is acted on by heat which can be produced in the pump and nozzle system during operation, for example as a result of electrical energy and/or armature friction or the like, bubbles may penetrate the pressure space. This can adversely affect the function of the pump and nozzle system, and in particular the injection process.

U.S. Pat. No. 5,351,893 discloses a generic type-forming fuel injection device which, with an electric linear motor, drives a pump plunger in a reciprocal to and fro movement. The plunger is a tubular element which is displaceably mounted in a pump chamber. At the, in the feed direction, front end of the pump plunger, a plug is provided against which the pump plunger strikes at the end of its delivery stroke, as a result of which a pump conduit which is arranged at the front, in the feed direction, of the plunger is shut off and the fuel located in it is acted on with a feed pressure. In this device, fresh fuel is fed through the tubular pump plunger to the pressure conduit, as a result of which the fuel feed path extends through the electromagnetic drive unit of the injection device.

DD-PS 213 472, in particular its FIG. 3, discloses a further fuel injection device which operates according to the energy storage principle and which has an electromagnetically actuated reciprocating plunger element which compresses a fuel located in a pressure conduit and sprays it out at an injection nozzle. The reciprocating plunger penetrates a low-pressure chamber which is connected to the pressure chamber by means of a small conduit, a non-return valve being arranged in the conduit. The low-pressure chamber is arranged adjacent to the drive unit of the injection device and has a diaphragm which is actuated by the reciprocating plunger element and which serves to feed fuel from the low-pressure chamber into the pressure conduit, the low-pressure chamber being fed fresh fuel directly. Since in each case only small partial quantities are transferred from the low-pressure chamber into the pressure conduit, the main quantity of the fuel located in the low-pressure chamber remains for a considerable dwell time in the low-pressure chamber in which the fuel is heated.

The object of the invention is largely to avoid the penetration of gas bubbles into the pressure space and in particular also the formation of gas bubbles in the pressure space of the pump and nozzle systems described at the beginning.

This object is achieved by means of the features of claim 1. Advantageous developments of the invention are distinguished in the subclaims.

The invention accordingly provides, in particular, a pressure chamber in which the energy stored in the armature and/or in the delivery plunger element is transmitted to the fuel, the pressure chamber being formed separately from the armature space or armature area by virtue of the fact that the valve which interrupts the displacement without resistance is arranged outside the armature space. As a result, the heat generated in the armature space is not transmitted directly to the pressure chamber, causing the heating of the fuel compressed during the injection process, and thus the risk of the formation of bubbles, to be significantly reduced. In addition, the pressure chamber is freely accessible and is directly provided with a fuel feed line, so that only "fresh" and thus cool fuel is located in the pressure chamber. For further cooling, the pressure chamber can be provided with cooling ribs, for example. In addition, the pressure chamber can have a small-volume design so that there is always only a small amount of fuel in the pressure chamber, and thus the risk of a high proportion of bubbles is already decreased.

In addition, owing to the small flood space with direct supply of fuel, it is also necessary to scavenge only small quantities of fuel.

The double or two-sided axial guidance of the armature leads to a reduction in friction brought about, for example, as a result of the tilting movement of the armature, which was previously possible, and thus to a reduction in the production of heat.

The functionally impairing effect of gas bubbles and/or the heating of the fuel are virtually excluded.

The double-sided axial guidance of the armature not only remedies the problems described above. In other known embodiments of the pump and nozzle systems it also leads to a simplification of the spatial shape, to the simplification and thus also homogenization of the physical shape and thus to the simplification of the assembly of the armature and/or of the pump, but also in particular also to the reduction of radial vibrations of the armature, said vibrations being possible in the known pump and nozzle systems owing to the merely one-sided axial guidance and to unavoidable and/or unnecessary play, which reduces the excessively high friction, between the armature outer surface and cylinder wall of the pump, and said vibrations adversely affecting the reproducibility of the injection processes.

Below, the invention is explained in more detail by way of examples with reference to the drawings, in which.

The fuel injection device, according to the invention, for internal combustion engines is designed as an electromagnetically driven reciprocating plunger pump 1, which operates according to the energy storage principle so that fuel is injected into the internal combustion engine with brief pressure surges.

Figure 2:
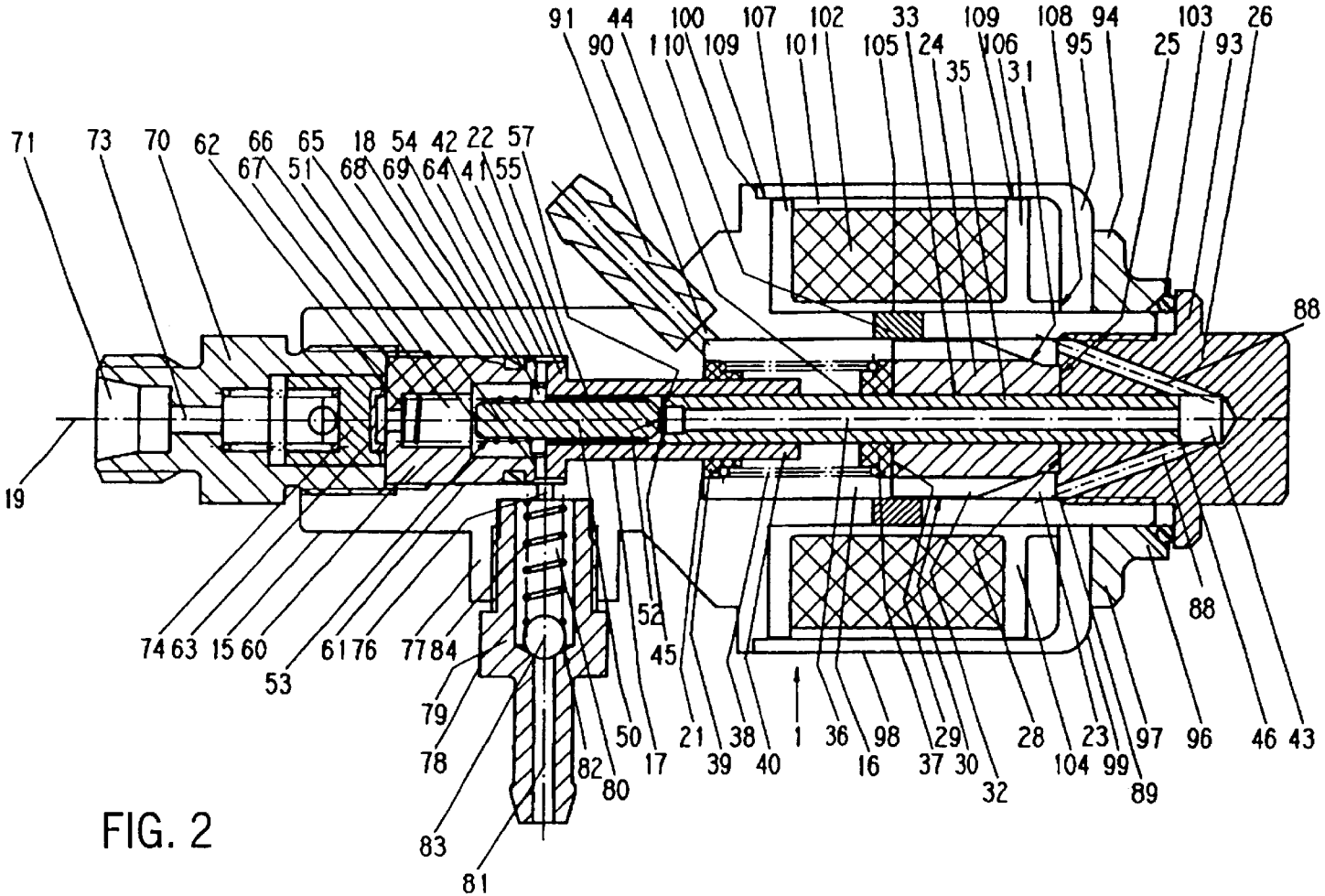
FIG. 2 shows a schematic view of a longitudinal section through a first exemplary embodiment of an injection pump according to the invention.
Figure 4:
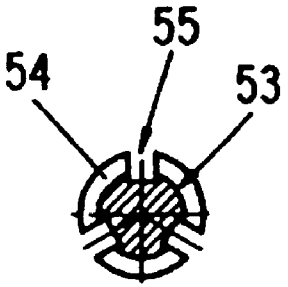
FIG. 4 shows a cross section through a valve body of the injection pump shown in FIG. 2.
Figure 3:
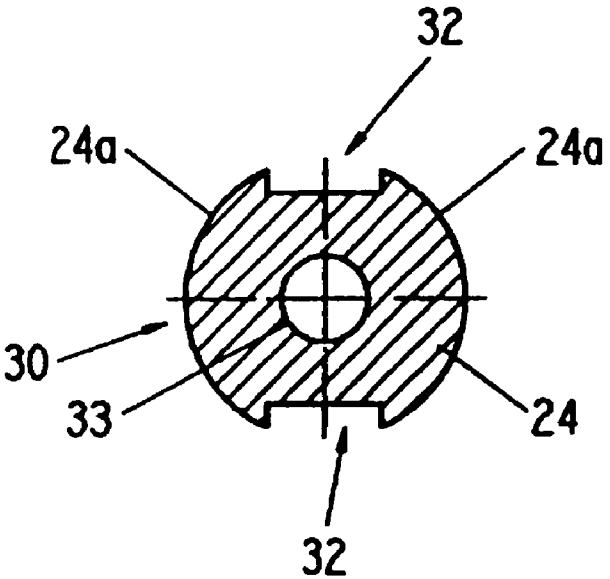
FIG. 3 shows a cross section through an armature of the injection pump shown in FIG. 2.

A first exemplary embodiment of the reciprocating plunger pump 1 according to the invention is shown in FIGS. 2 to 4.

The reciprocating plunger pump 1 has a cylindrical pump casing 15, which is essentially elongated and has an armature bore 16, a valve bore 17 and a pressure chamber bore 18, which are each provided one behind the other in the pump casing 15 and form a passage extending through the entire pump casing 15. The armature bore 16 is arranged behind the valve bore 17 in the injection direction, and the pressure chamber bore 18 is arranged in front of the valve bore 17 in the injection direction. The bores 16, 17, 18 are arranged concentrically with respect to the longitudinal axis 19 of the pump casing 15, the armature bore 16 and the pressure chamber bore 18 each having a larger internal diameter than the valve bore 17, so that the armature bore 16 and the valve bore 17 are offset from one another by means of a first annular step 21 and the valve bore 17 and the pressure chamber bore 18 are offset from one another by means of a second annular step 22.

The armature bore 16 bounds an armature space 23 in the radial direction, in which armature space 23 an approximately cylindrical armature 24 is arranged so as to be capable of moving to and fro in the direction of the longitudinal axis. The armature space is bounded toward the front in the axial direction by the first annular step 21 and toward the rear by a front end face 25 of a cylindrical closure plug 26, which is screwed into the end of the armature bore 16 which is open toward the rear in the injection direction.

The armature 24 is formed from an essentially cylindrical element with an, in the injection direction, front end face 28 and a rear end face 29 and an outer face 30. Material is removed at the circumferential area of the armature from the rear end face 28 approximately as far as the longitudinal center of the armature 24, so that the armature 24 has a conical face 31 which runs from the rear to the front on the outside. The armature 24 is inserted with play between its outer face 30 and the inner face of the armature bore 16, so that, when the armature 24 is moving to and fro in the armature bore 16, the latter touches the inner face of the armature bore 16 only during tilting movements of the armature 24, as a result of which the friction between the armature 24 and the armature bore 16 is kept low. As a result of the provision of the conical face 31 on the armature 24, the contact area, and thus the frictional area, are reduced further, as a result of which the friction between the armature 24 and the inner face of the armature bore 16, and thus also the generation of heat, are further reduced. The armature 24 is provided, in the area of its outer face 30, with at least one, preferably two or more grooves 32 running in the direction of the longitudinal axis. The armature 24 has a cross-sectional shape (FIG. 3) with two laterally arranged semicircular elements 24*a* and with two broad, flat grooves 32 in the area between the semicircular elements 24*a*. A continuous bore 33 is provided centrally on the armature 24 in the direction of the longitudinal axis.

A delivery plunger pipe 35, which forms a central passage space 36, is inserted into the bore 33 of the armature 24. A plastic ring 37, through which the delivery plunger pipe 35 engages, is seated on the front end face 29 of the armature 24. On the plastic ring 37, an armature spring 38, which extends as far as a corresponding bearing ring 39, is supported toward the front. This bearing ring 39 is seated on the first annular step 21 in the armature bore 16.

The delivery plunger pipe 35 is connected to the armature 24 in a frictionally locking fashion. The unit comprising the delivery plunger pipe 35 and armature 24 is designated below as delivery plunger element 44. The delivery plunger element 44 may also be of single-component or single-piece design.

In the valve bore 17, a guide pipe 40, which extends rearward into the armature space 23 into the area inside the helical spring 38, is seated in a positively locking fashion. At the, in the injection direction, front end of the guide pipe 40, an outwardly protruding annular web 41 is provided, which web 41 is supported on the second annular step 22 toward the rear. The annular web 41 extends radially not quite as far as the inner face of the pressure chamber bore 18, so that a narrow, cylindrical gap 42 is formed between the annular web 41 and the pressure chamber bore 18. The guide pipe 40 is secured against axial displacement to the rear by means of the annular web 41.

The delivery plunger pipe 35 which is connected to the armature 24 in a frictionally locking manner extends toward the front as far as the guide pipe 40 and toward the rear into an axial blind bore 43 of the closure plug 26, so that the delivery plunger pipe 35 is guided both at its, in the injection direction, front end 45 and at its rear end 46. This two-sided guidance at the ends 45, 46 of the elongated delivery plunger pipe 35 guides the delivery plunger element 44 in a non-tilting fashion, so that undesired friction between the armature 24 and the inner face of the armature bore 16 is reliably avoided.

A valve body 50, which forms an essentially cylindrical, elongated, pin-shaped solid body with front and rear end faces 51, 52 and an outer face 53, is mounted so as to be axially displaceable in the front area of the guide pipe 40. The external diameter of the valve body 50 corresponds to the clearance width of the passage in the guide pipe 40. An annular web 54, which is arranged approximately at the end of the front third of the valve body 50, is provided on the outer face 53 of the valve body 50. The annular web 41 of the guide pipe 40 forms, for the annular web 54 of the valve body 50 in the position of rest of the valve body 50, an abutment so that the latter can no longer be displaced rearward. The valve body 50 is provided at its circumference with three grooves 55 running in the direction of the longitudinal axis (FIG. 4). The annular web 54 is interrupted in the area of the grooves 55.

The rear end face 52 of the valve body 50 is of conical design at its edge area and interacts with the end face of the front end 45 of the delivery plunger pipe 35. The spatial shape of the front end 45 of the delivery plunger pipe 35 is matched to the rear end face 52 of the valve body 50, in that the inner edge of the delivery plunger pipe 35 is chamfered and the wall of the delivery plunger pipe 35 is cut away somewhat toward the inside. The delivery plunger pipe 35 thus forms with its front end 45 a valve seat 57 for the valve body 50. If the valve body 50 rests with its rear end face 52 against the valve seat 57, the passage through the grooves 55 provided in the area of the outer face of the valve body SO is blocked.

The area of the valve body So which protrudes forward out of the guide pipe 40 into the pressure chamber bore 18 is surrounded by a pressure chamber element 60, which comprises a cylindrical wall 61 and a front end wall 62, a hole or a bore 63 being provided centrally in the end wall 62. The pressure chamber element 60 is plugged with its cylindrical wall 61 into the pressure chamber bore 18 in a positively locking fashion, in which case it is arranged with its end faces 64 on the free end of the cylinder wall 61 abutting against the outwardly protruding annular web 41 of the guide pipe 40, radial passage bores 65, which provide a connection between the pressure chamber 66 and the fuel feed bore 76, being provided in the pressure chamber element 60.

The pressure chamber element 60 bounds with its interior a pressure chamber 66 into which the valve body 50 can dip and pressurize the fuel in the pressure chamber 66. The pressure chamber has at its, in the injection direction, rear area, which extends approximately over half the length of the pressure chamber element 60, a larger clearance width than at the front area. The larger clearance width in the rear area is dimensioned such that the valve body 50 can dip with its annular web 54 into the pressure chamber 66 with a small amount of play, whereas the clear width of the front area is dimensioned such that there is sufficient space only for the area of the valve body 50 which extends forward from the annular web 54 and for a helical spring 67 which surrounds said area. As a result, the pressure chamber 66 is of only slightly larger design than the space required during the surge movement of the valve body 50 carried out during the injection process.

The helical spring 67 is seated with one end on the inside of the end wall 62 of the pressure chamber element 60 and bears with its other end against the valve element 50, and in particular against its annular web 54, so that it pushes the valve body 50 and the pressure chamber element 60 apart.

Figure 1:
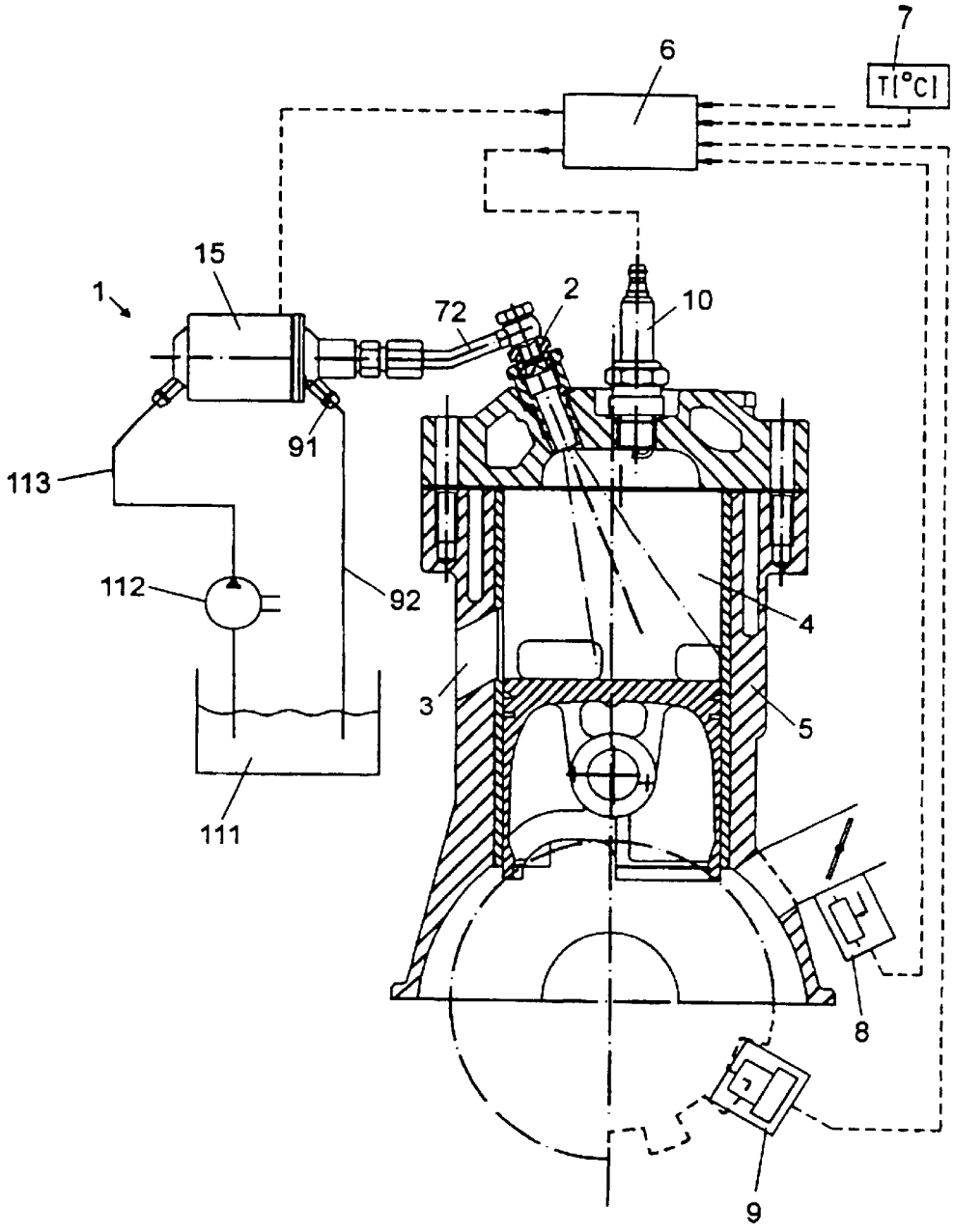
FIG. 1 shows a schematic view of the arrangement of a fuel injection device for a single-cylinder two stroke engine.

The pressure chamber element 60 is secured axially toward the front in the injection direction by a connecting element 70 which is screwed into the end of the pressure chamber bore 18 which is open at the front. The connecting element 70 bounds the position of the pressure chamber element 60 toward the front in the axial direction so that the valve body 50 is prestressed toward the rear by the helical spring 67. On the outside, the connecting element is designed with a mouth 71 for connecting a fuel feed line 72 (FIG. 1). The connecting element 70 has a bore 73 which is continuous in the direction of the longitudinal axis and in which a static pressure valve 74 is accommodated. The static pressure valve is preferably arranged adjacent to the pressure chamber element 60.

The pressure chamber element 60 is provided on its outer surface with an annular groove 68 in which a plastic sealing ring 69 is mounted, said sealing ring 69 sealing the pressure chamber element 60 with respect to the inner face of the pressure chamber bore 18.

For the supply of fuel, a fuel supply opening 76 is provided on the pump casing 15 in the area of the pressure chamber bore 18, so that it can communicate with the bores 65 in the pressure chamber element 60. On the outside of the pump casing 15, the fuel supply opening 76 is surrounded by a socket 77 for a fuel feed valve 78 which is screwed into the socket 77. The fuel feed valve 78 is designed as a one-way valve with a valve casing 79. The valve casing 79 has two axially aligned bores 80, 81, the pump casing-side bore 80 having a larger internal diameter than the bore 81, so that an annular step, which forms a valve seat 82 for a sphere 83, is constructed between the two bores. The sphere 83 is prestressed against the valve seat 82 by a spring 84 which is supported in the bore 80 in the area around the fuel feed opening 76 on the pump casing 15, so that fuel fed under pressure from the outside lifts the sphere 83 from the valve seat 82, so that the fuel is fed through the bore 80 and the fuel feed opening 76 into the pressure chamber bore 18.

A passage extends from the pressure chamber 66 through the grooves 55 of the valve body 50, the distance between the valve seat 57 of the delivery plunger pipe 35 and the rear end face 52 of the valve body 50 and the passage space 36 of the delivery plunger pipe 35 as far as the blind hole 43 of the closure plug 26. The blind hole or blind bore 43 is arranged running in the direction of the longitudinal axis and opens into the armature space 23, the blind hole 43 extending over approximately two-thirds to three-quarters of the length of the closure plug 26. From the rear area of the blind hole 43, one, preferably two or more long bores 88 extend to the peripheral area 89 of the front end face 25 of the closure plug 26, so that a communicating connection is produced between the armature space 23 and the blind hole 43.

An outwardly leading bore 90 is provided, as fuel discharge opening, at the periphery area of the first annular step. The bore 90 is extended on the outside through a connecting element 91 for connection to a fuel return line 92 (FIG. 1).

The cylindrical closure plug 26 has, on its outer face, a circumferential, outwardly protruding annular web 93. The annular web 93 serves, inter alia, also for axially securing a locking ring 94 which engages around the outside of the pump casing 15 or a coil casing cylinder 95 which is arranged directly adjoining the locking ring 94. The locking ring 94 forms, in cross section, two limbs 96, 97 which are arranged at right angles to one another, the one limb 96 bearing against the outside of the pump casing 15 and the other limb 97 protruding outward and bearing against the coil casing cylinder. The coil casing cylinder 95 is composed of a cylinder wall 98 and of a cylinder base 99 which is joined laterally to the cylinder wall 98 pointing inward and has a hole so that the coil casing cylinder 95 is fitted onto the coil casing 15 from the rear with the cylinder base 99 pointing toward the rear, until the cylinder wall 98 strikes against a casing wall 100 which protrudes perpendicularly outward from the coil casing 15, and thus bounds an annular chamber 101 with approximately rectangular cross section for holding a coil 102.

The coil casing cylinder 95 and the locking ring 94 are thus clamped in between the casing wall 100 and the annular web 93 of the closure plug 26 and secured in their axial position. The limb 96 of the locking ring 94 is chamfered at the inner edge of its end face, a sealing ring 103, such as an O ring, for example, being clamped in between the chamfer formed in said end face and the annular web 93.

The coil 102 is approximately rectangular in cross section and cast in a supporting element cylinder 104, with an approximately U-shaped cross section, by means of epoxy resin, so that the coil 102 and the supporting element cylinder 104 form a single-component coil module. The supporting element cylinder 104 has a cylinder wall 105 and two side walls 106, 107, which protrude radially from the cylinder wall 105 and bound the space for the coil 102, the cylinder wall 105 extending out laterally over the rear side wall 106, so that its end face 108, the end face 109 of the side walls 106, 107 and the inner faces of the cylinder wall 106 and the front side wall 107 bear in the annular chamber 101 in a positively locking fashion.

In the area of the pump casing 15, which is arranged between the coil 102 and the armature space 23, a material 110 with a low magnetic permeability, for example copper, aluminum, stainless steel, is provided in order to avoid magnetic short-circuiting between the coil 102 and the armature 24.

Figure 5:
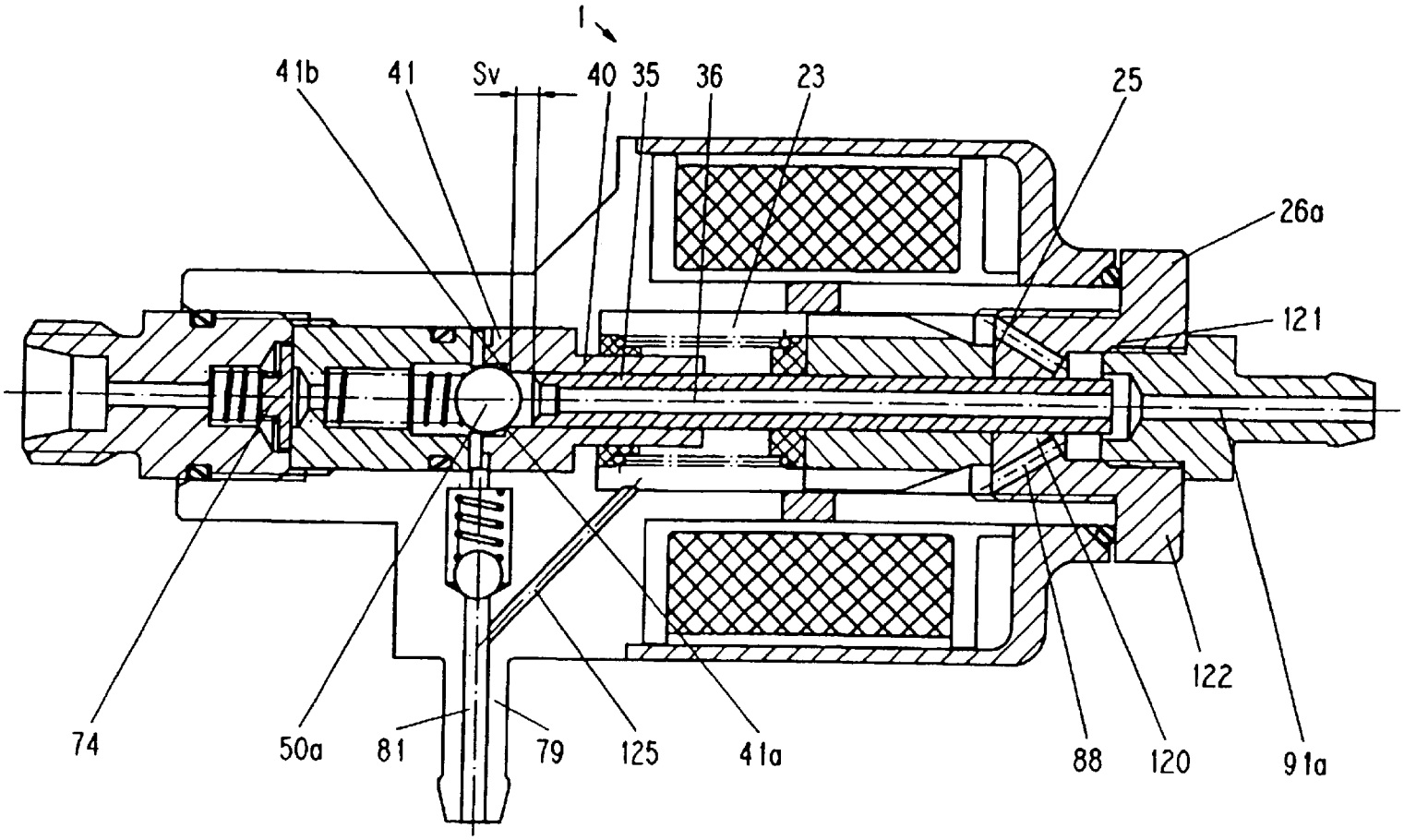
FIG. 5 shows a schematic view of a longitudinal section through a second exemplary embodiment of an injection pump according to the invention.

A second exemplary embodiment of the injection pump according to the invention is illustrated in FIG. 5.

The reciprocating plunger pump 1 in accordance with the second exemplary embodiment has essentially the same design as the reciprocating plunger pump 1 described above, so that components with an identical spatial shape and identical function are distinguished with the same reference symbols.

The reciprocating plunger pump 1 in accordance with the second exemplary embodiment is of shorter design in its longitudinal extent than the reciprocating plunger pump in accordance with the first exemplary embodiment, the shortening being achieved essentially by using a sphere 50*a* as valve body. The annular web 41 of the guide pipe 40 forms, in the position of rest, an abutment for the sphere 50*a*, so that the latter cannot be displaced further toward the rear. The annular web 41 is designed with an annular sphere seat 41 which is matched to the spherical shape, so that in certain areas the sphere 50*a* bears against the annular web 41 in a positively locking fashion.

The sphere 50*a* has a smooth surface, for which reason grooves 41*b* are provided in the sphere seat 41*a*, said grooves 41*b* connecting the pressure chamber 66 to the gap between the valve seat 57 of the delivery plunger pipe 35 and the surface of the sphere 50*a* if the latter is arranged at a distance from the valve seat 57. The provision of the grooves 41*b* enables the pressure chamber 66 to be scavenged.

The closure plug 26*a* of this exemplary embodiment has a central, first bore 120 which extends from the front end face 25 and in which the delivery plunger pipe 35 is guided and which corresponds to the blind hole 43 of the closure plug 26 of the first exemplary embodiment. The first bore 120 opens into a second bore 121 of the closure plug 26*a*. The bores 120, 121 are arranged concentrically with respect to the longitudinal axis 19 of the pump casing 15 and/or of the closure plug 26*a*. The second bore 121 extends as far as the rear end face 122 of the closure plug 26*a* and is provided with an inner thread for receiving a connecting element 91*a* for connecting a fuel return line 92. In the home position, the flow path for scavenging the delivery plunger pipe 35 extends from the fuel feed valve 78 into the pressure chamber 66 through the grooves 41*b* into the gap between the valve seat 57 and the sphere 50*a* and through the passage space 36 of the delivery plunger pipe 35 into the bore 121 and/or through the connecting element 91*a* into the fuel return line 92. This flow path thus does not flow through the armature space 23.

In order to scavenge the armature space 23, a transverse flow path is provided which has a transverse flow bore 125 which extends between the bore 81 of the valve casing 79 and the armature space 23 and connects the latter to one another. The bore 81 of the valve casing 79 lies outside the fuel feed valve 78, so that the supplied fuel is passed directly into the armature space 23 without any constriction points. The fuel thus flows from the armature space 23 through the bores 88 into closure plugs 26*a* in the second bore 121 in which the connecting element 91*a* is seated, and through the connecting element 91*a* into the fuel return line 92. The transverse flow path thus forms a type of bypass for the flow path through the passage space 36 of the delivery plunger pipe 35.

When the production of heat in the armature space 23 is strong, the transverse flow path is advantageous, since the armature space 23 is scavenged with cool fuel, the scavenging of the armature space 23 being carried out with a high throughput volume since the transverse flow path does not have any constriction points, for example valve passages or groove passages which would impede the flow.

The provision of the transverse flow path permits the armature space 23 to be scavenged without an additional fuel pump applying an admission pressure to the supplied fuel, since, owing to the suction effect of the reciprocating plunger pump 1, fuel is also fed into the transverse flow path.

In specific applications, in particular when there is a low production of heat, it may be expedient to make the armature space 23 dry in order to keep the armature 24 as freely moving as possible. To this end, neither the transverse flow bore 125 nor the bores 88 are provided in the closure plug 26*a*, so that the armature space 23 is separated from the flow path.

The method of operation of the injection device according to the invention is explained below with reference to the first exemplary embodiment of the invention.

If the flow is interrupted by the coil 102, the armature 24 is pressed by the helical spring 38 rearward against the closure plug 26 against which it bears with its rear end face 49. This is the home position of the armature 24, in which position the delivery plunger pipe 35 is arranged with its valve seat 57 spaced apart from the rear end face 52 of the valve body 50 by a distance $S_v$.

In this home position, a fuel which is at an admission pressure is fed from the fuel tank 111 through the fuel feed valve 78 into the pressure chamber 66 by means of a fuel pump 112 and a fuel feed line 113. The fuel flows from the pressure chamber 66 through the grooves 55 provided in the outer area of the valve body So through the guide pipe 40 into the gap between the valve seat 57 of the delivery plunger pipe 35 and the rear end face 52 of the valve body and through the passage space 36 of the delivery plunger 35 into the blind hole 43 of the closure plunger 26. The pressurized fuel flows out of the rear end area of the blind hole 43 through the bores 88 of the closure plug 26 and floods the armature space, the areas of the armature space in front of and behind the armature 24 being connected so that they communicate with one another through the grooves 32 provided in the armature 24, with the result that the entire armature space is filled with fuel. The fuel is directed back into the fuel tank 111 through the bore 90 and the connecting element 91 and through a fuel return line 92.

Thus, in the home position of the delivery plunger element 44, a flow path for the fuel extends from the fuel feed valve 78 via the pressure chamber 66, the passage space 36 of the delivery plunger 35, the blind hole 43 and the bore 88 in the closure plug 26, the armature space 23 and the bore 90 to the connecting element 91, so that fuel is fed continuously and scavenged through the passage, the pressure chamber always being supplied and flooded with fresh, cool fuel directly from the fuel tank 111.

The admission pressure generated by the fuel pump 112 is greater than the pressure drop produced in the flow path, so that a continuous scavenging of the reciprocating plunger pump 1 is ensured and is lower than the gate pressure of the static pressure valve 74, so that in the home position of the delivery plunger element 44 no fuel is fed into the combustion space 4.

If the coil 102 is excited by applying an electric current, the armature 24 is moved forward in the surge or injection direction by the magnetic field thus generated. During a pretravel over the length $s_v$ (corresponds to the distance between the valve seat 57 of the delivery plunger pipe 35 and the rear end face 52 of the valve body 50 in the home position), only the spring force of the spring 38 counteracts the movement of the armature 24 and the delivery plunger pipe 35 connected thereto in a frictionally locking fashion. The spring force of the spring 38 is designed to be so weak that the armature 24 is moved virtually without resistance but nevertheless is sufficient for returning the armature 24 into its home position. The armature 24 "floats" in the pressure space 23 filled with fuel, the fuel being able to flow to and fro in the desired way in front of and behind the armature 24 in the armature space 23, so that no pressure counteracting the armature 24 is built up. The delivery plunger element 44, comprising armature 24 and the delivery plunger pipe 35, is thus continuously accelerated and stores kinetic energy.

At the end of the pretravel, the delivery plunger element 44 impacts, with the valve seat 57, against the rear end face 52 of the valve body 50, so that the latter is suddenly pressed forward. Since the delivery plunger pipe 35 then bears with its valve seat 57 against the rear end face 52 of the valve body 50, the flow path from the pressure chamber to the passage space 36 of the delivery plunger pipe 35 is interrupted so that the fuel can no longer escape to the rear from the pressure chamber 66. The fuel is thus displaced through the pretravel movement of the valve body 50 in the pressure chamber 66, said fuel being pressurized. The fuel feed valve 78 is now closed, since a pressure builds up in the pressure chamber and in the bore 80 of the fuel feed valve 78 which is greater than the pressure with which the fuel is fed by the fuel pump. Starting from a predetermined pressure, the static pressure valve 74 then opens, so that the fuel located in the feed line between the injection nozzle 2 and the reciprocating plunger pump 1 is compressed to a predetermined pressure which is, for example, 60 bar and is determined by the gate pressure of the injection nozzle 2. When the delivery plunger 44 impacts, the energy stored in the movement of the delivery plunger element is thus suddenly transmitted to the fuel located in the pressure chamber 66.

The injection nozzle 2 sprays the fuel directly into the cylinder 5 of the internal combustion engine, the fuel being finely atomized by the nozzle 2 owing to the high pressure which is achieved with the injection device according to the invention.

The static pressure valve 74 is a non-return valve, such non-return valves conventionally having a bore in a valve seat against which a rigid valve body is pressed by a spring. The conventional static pressure valves 74 close off the inflow line into the fuel feed line 72 very quickly and reliably. In such cases, a static pressure, which is often only slightly less than the opening pressure of the injection nozzle 2, remains in the fuel feed line 72.

As a result of temperature fluctuations, the pressure in the fuel feed line 72 can change, so that the injection nozzle opens and fuel enters the combustion space at a predeterminable time, as a result of which the pollutant values in the emissions are considerably increased.

On the other hand, the static pressure valve 74 in the fuel feed line 72 is intended to maintain a specific permanent pressure level of approximately 5 to 10 bar in order to prevent the formation of vapor bubbles.

For this reason, a further object of the invention is to provide a static pressure valve which excludes the possibility of fuel unintentionally entering the combustion space and, in particular, also prevents the formation of vapor bubbles.

The object is achieved by means of a static pressure valve having the features of claim 17. Here, the inflow line to the fuel feed line is closed off quickly and reliably, and in the fuel feed line a static pressure is brought about which assumes a level which is significantly below the gate pressure of the injection nozzle and above the level necessary to avoid the formation of vapor bubbles.

Figure 6:
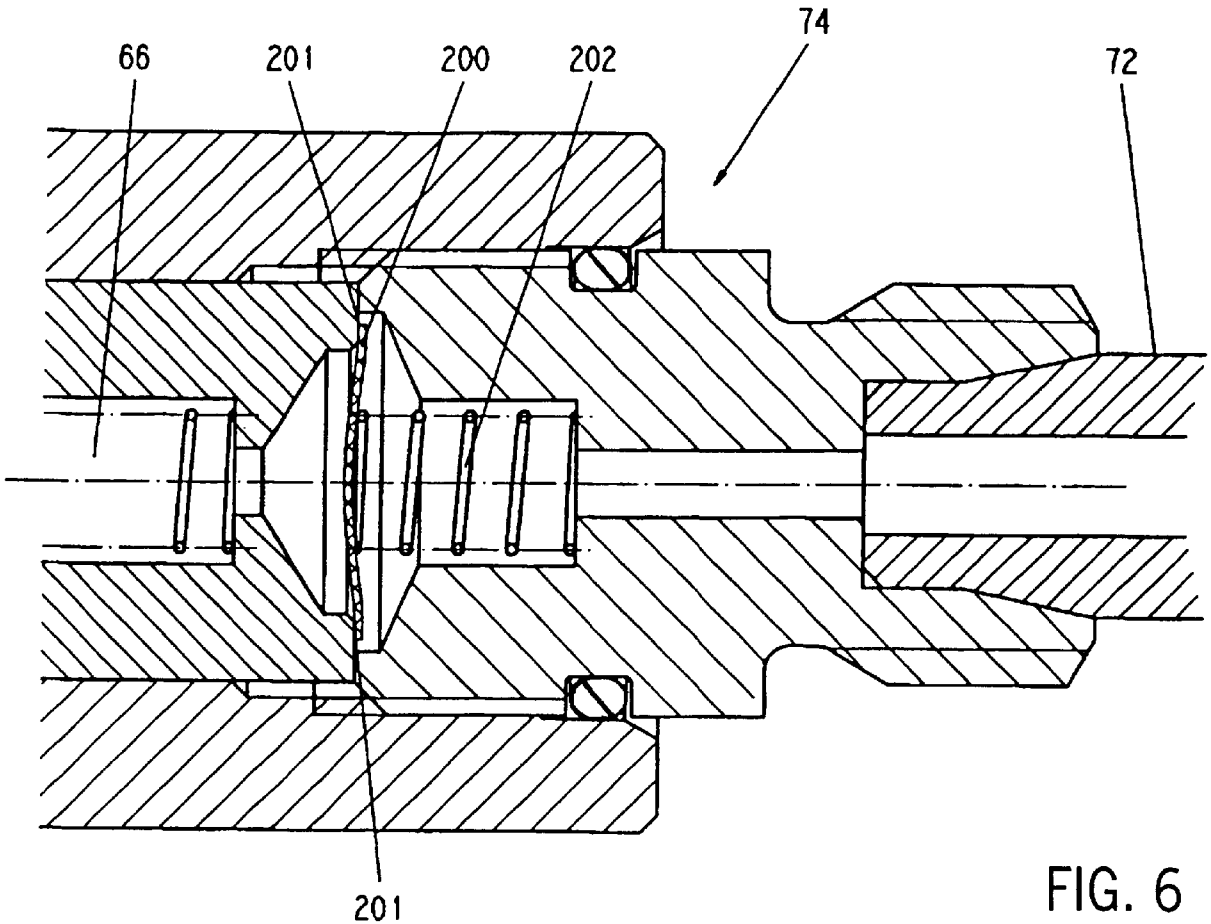
FIG. 6 shows a schematic view of a longitudinal section through a static pressure valve.

The static pressure valve 74 according to the invention has, as valve body, a flat, elastic diaphragm 200 which is pressed against a valve seat device 201 by a spring 202 (FIG. 6).

In the opened position of the static pressure valve 74, fuel is fed under high pressure in the direction of the injection nozzle 2 from the outside of the static pressure valve or the pressure chamber 66, the diaphragm 200 being lifted off the valve seat 201. In the process, the same pressure is established on both sides of the diaphragm 200, so that the pressure present on the two flat sides of the diaphragm 200 is in equilibrium. In this context, the diaphragm assumes a planar shape.

If the pressure from the outside of the static pressure valve decreases, the spring 202 presses the diaphragm 200 onto the valve seat 201, the static pressure valve being closed at a predetermined closing pressure. If the pressure on the outside of the static pressure valve decreases further, the diaphragm 200 is curved outward toward the pressure chamber 66 by the pressure prevailing on the spring side, so that the fuel in the fuel feed line 72 can expand or spread out somewhat, as a result of which its pressure level is reduced. Thus, the provision of the elastic diaphragm 200 enables a further pressure drop below the closing pressure of the static pressure valve 74 after the static pressure valve 74 closes. In addition, pressure fluctuations occurring in the fuel feed line 72 are compensated by the elasticity of the diaphragm 200, so that an unintentional increase in pressure in the fuel feed line 72, and thus unintentional opening of the injection nozzle, are avoided.

Preferably, the static pressure valve 74 is designed in such a way that the spring 202 moves the diaphragm 200 into an area which lies axially within the support of the diaphragm 200 onto [sic] the valve seat 201, so that the diaphragm 200 is always curved by the spring effect of the spring 202 on the valve seat 201.

The diaphragm 200 can be designed from rubber or metal, a rubber diaphragm being expediently surrounded by a metal frame which stiffens the diaphragm.

What is claimed is:

1. A fuel injection device which operates according to the solid-state energy storage principle comprising:

a reciprocating plunger pump having a front and rear orientation and including a pump case in which a delivery plunger element is arranged which, during an acceleration phase which is virtually without resistance, stores kinetic energy which is suddenly transmitted to fuel located in a pressure chamber, so that a pressure surge is generated for spraying fuel through an injection nozzle device;

means interrupting the acceleration phase which is virtually without resistance being a valve which comprises a valve body and a valve seat formed on the delivery plunger element for closing the pressure chamber in order to generate the pressure urge, as a result of which the kinetic energy of the delivery plunger element is transmitted to the fuel enclosed in the pressure chamber; and said valve seat and the valve body being arranged at a front end of the delivery plunger element so that the pressure chamber is designed so as to be spatially separated from the delivery plunger element, wherein said pressure chamber is provided with a fuel feed opening leading directly outside the pump casing for feeding fuel, the fuel feed opening being connected to a fuel feed line so that fresh pressurized fuel is fed to the pressure chamber.

2. The fuel injection device as claimed in claim 1 wherein the fuel feed opening is arranged on a pump casing surrounding the pressure chamber.

3. The fuel injection device as claimed in claim 1 wherein the fuel injection device is designed as an electromagnetically activated reciprocating plunger pump with a magnet coil for driving said delivery plunger element, the delivery plunger element having a generally cylindrically shaped armature and an elongated delivery plunger pipe, front and rear ends of said delivery plunger pipe extending beyond the armature in the direction of the longitudinal axis and each being mounted in recesses in a positively locking fashion and so as to be displaceable in the direction of the longitudinal axis.

4. A fuel injection device as claimed in claim 3, wherein the delivery plunger pipe is connected to the armature in a frictionally locking fashion, the valve seat being arranged at the front end of the delivery plunger pipe.

5. A fuel injection device as claimed in claim 4, wherein the valve body is an elongated, essentially cylindrical solid body which is mounted so as to be axially displaceable in a guide pipe, the valve body being provided with circumferential grooves which extend in the longitudinal direction and which form a passage from the pressure chamber into a passage space within the delivery plunger pipe, the passage being blocked when the delivery plunger pipe bears, with said valve seat, against the valve body, whereby said pressure chamber is closed.

6. The fuel injection device as claimed in claim 3 wherein the armature has a front end face, a rear end face, an outer face, and a conical face, said conical face extending from near the rear end face forward approximately as far as the longitudinal center of the armature.

7. The fuel injection device as claimed in claim 3 wherein the reciprocating plunger pump has a pump casing with an armature bore in which an armature space is bounded by the armature bore toward the rear and by a closure plug, and said armature space is bounded toward the front by a first annular step in which said armature space and the armature are moved to and fro by means of said magnetic coil and a spring which acts on the armature in the direction of the longitudinal axis, the armature being formed with at least two longitudinally extending grooves in its circumference in a symmetrical distribution.

8. The fuel injection device as claimed in claim 8 wherein the armature assumes a home state as a result of the biasing of said spring when said coil is de-energized, and, in this home state, a continuous flow path for pressurized fuel is formed from the pressure chamber through the grooves of the valve body, the passage space of the delivery plunger pipe and through a blind hole and at least one bore in the closure plug.

9. The fuel injection device as claimed in claim 9 wherein the armature space is connected to a fuel return line via a bore which leads outside of said casing and through a connecting element.

10. The fuel injection device as claimed in claim 10 wherein the closure plug is provided with a continuous bore through which fuel is led off from the fuel injection device into the fuel return line.

11. The fuel injection device as claimed in claim 1 including a transverse flow bore through which fuel is fed directly to the armature space, said closure plug bores connecting the armature space to said continuous bore of the closure plug so that a transverse flow path is formed for scavenging the armature space, which transverse flow path is independent of the passage space in the delivery plunger element.

12. The fuel injection device as claimed in claim 1 wherein the pressure chamber is bounded by a static pressure valve which opens at a predetermined pressure to clear the passage into a fuel feed line connected to an injection nozzle.

13. The fuel injection device as claimed in claim 1 wherein the pressure chamber is only slightly larger than the space which is taken up by the surge movement of the valve body which is carried out during the injection process.

14. The fuel injection device as claimed in claim 1 which operates according to the solid-state energy storage principle, a delivery plunger element being provided which, during an acceleration phase which is virtually without resistance, stores kinetic energy which is suddenly transmitted to fuel located in a pressure chamber so that a pressure surge is generated for spraying fuel through an injection nozzle device, the fuel injection device being designed as an electromagnetically activated reciprocating plunger pump and the delivery plunger element comprising an armature and an elongated delivery plunger pipe, which plunger pipe is connected to the armature in a frictionally locking fashion and extends beyond the armature in the direction of the longitudinal axis, the ends of the plunger pipe each being guided in recesses in a positively locking fashion.

15. A method for injecting fuel into a two-stroke internal combustion engine comprising the steps of:

providing a reciprocating plunger pump casing and a delivery plunger element;

moving said delivery plunger element with virtually no resistance to store kinetic energy;

interrupting said moving delivery plunger element to generate a pressure surge;

applying said pressure surge to fuel in a pressure chamber;

using a valve seat and a valve body arranged at the front end of said delivery plunger element to separate said pressure chamber from the delivery plunger element;

providing a fuel feed conduit to said pressure chamber from outside of said pump casing; and providing fresh pressurized fuel to said pressure chamber through said fuel feed conduit.

16. A method as claimed in claim 15 including the steps of:

providing a coil in said casing;

providing an armature in said casing, circulating fresh fuel passed said armature.

17. A method as claimed in claim 16 including the steps of:

supporting said armature at both of its ends.

* * * * *